US008282114B2

(12) United States Patent
Magee

(10) Patent No.: US 8,282,114 B2
(45) Date of Patent: Oct. 9, 2012

(54) SKATEBOARD DECK

(76) Inventor: Thane G. Magee, San Diego, CA (US)

( * ) Notice: Subject to any disclaimer, the term of this patent is extended or adjusted under 35 U.S.C. 154(b) by 524 days.

(21) Appl. No.: 11/607,752

(22) Filed: Nov. 30, 2006

(65) Prior Publication Data

US 2008/0129004 A1 Jun. 5, 2008

(51) Int. Cl.
*B62M 1/00* (2010.01)

(52) U.S. Cl. ..... 280/87.042; 280/610

(58) Field of Classification Search ..... 280/87.041, 280/87.042, 610, 601, 14.21, 608
See application file for complete search history.

(56) References Cited

U.S. PATENT DOCUMENTS

| | | | | |
|---|---|---|---|---|
| 1,703,936 | A | 3/1929 | Jervoise | |
| 2,162,128 | A | 6/1939 | Shoemaker | |
| 2,664,294 | A | 12/1953 | Kleinman | |
| 3,023,022 | A | 2/1962 | Boyden | |
| 3,653,678 | A | 4/1972 | Collett | |
| 4,082,306 | A | 4/1978 | Sheldon | |
| 4,155,565 | A | 5/1979 | de Caussin et al. | |
| 4,209,867 | A * | 7/1980 | Abrams, III | 441/74 |
| 4,955,626 | A | 9/1990 | Smith et al. | |
| 5,154,436 | A | 10/1992 | Jez et al. | |
| 5,540,455 | A | 7/1996 | Chambers | |
| 5,573,264 | A * | 11/1996 | Deville et al. | 280/602 |
| 5,855,389 | A * | 1/1999 | Andrus et al. | 280/602 |
| 5,901,588 | A | 5/1999 | Frost | |
| 6,494,467 | B1 * | 12/2002 | Menges | 280/14.21 |
| 6,994,369 | B2 * | 2/2006 | Restani | 280/610 |
| 7,014,206 | B2 * | 3/2006 | Donze | 280/602 |
| 7,083,178 | B2 | 8/2006 | Potter | |
| 2002/0030338 | A1 * | 3/2002 | Bert | 280/87.041 |
| 2004/0084878 | A1 * | 5/2004 | Adamczewski | 280/602 |
| 2004/0100068 | A1 * | 5/2004 | Restani | 280/610 |
| 2004/0188967 | A1 * | 9/2004 | Gallo | 280/87.041 |
| 2005/0134013 | A1 * | 6/2005 | Wright et al. | 280/87.042 |
| 2006/0049596 | A1 * | 3/2006 | Hill et al. | 280/87.042 |

* cited by examiner

*Primary Examiner* — Hau Phan
*Assistant Examiner* — Bryan Evans
(74) *Attorney, Agent, or Firm* — Donn K. Harms

(57) ABSTRACT

A skateboard deck formed of laminated layers having increased twisting resistance around its center axis provided by fiber reinforced polymer matrix composite members running along the center axis and cross members extending toward side edges. Side members positioned between pairs of cross members provide additional torque resistance and energy storage for use in springing the board.

19 Claims, 2 Drawing Sheets

SKATEBOARD DECK

FIELD OF THE INVENTION

The present invention relates to skateboards. More particularly, it relates to a laminated construction of a skateboard deck which employs one or a plurality of internal planar metal strips which provide an increase in the spring-back of the skateboard and additionally provide for construction variation and adjustment to adapt the torque characteristics of the resulting deck to user riding styles and intended use or venue. Shock absorption is also provided by the construction of the device.

STATE OF THE ART

The recreational sport of skateboarding developed as an offshoot of surfing sometime in the late 1960s when roller skates were first separated into two components and nailed to the bottom of a board which served as the deck. Consequently, the skateboard is essentially a land surfing vehicle. In recent years, the sport of skateboarding has become popular in many parts of the world. With this popularity has evolved ever more complicated rider maneuvers and tricks that a skateboard must be constructed to perform. Maneuvers such as the Ollie, the Switch Ollie, the 50/50 Grind, the Kick Flip, and many others are well known. Such rider maneuvers require both rider skill and a skateboard capable of handling the stresses such maneuvers impart to the board, both on launch and landings and during turns and twists in riding.

As a natural consequence of the ever progressive nature of the number and complication of old tricks and constantly invented new tricks, the skateboard itself must improve in performance to allow for improved rider performance of conventional maneuvers. Further, a board with certain structural improvements yielding improved handling and flex will allow riders to improve performance on conventionally known maneuvers as well as to invent new tricks and maneuvers.

A conventional skateboard typically includes a board or deck on which the rider stands to both ride on rolling wheels and to perform jumps and tricks. Conventional skateboard decks range between 6 to 12 inches in width and from 33 inches to 43 inches in length. However, there are specialized short decks and long boards or decks which are also employed to stand upon of other lengths depending on the desired performance characteristics of the specialty board for its use.

Such boards or decks are generally manufactured of wood or fiberglass material or combinations of wood and fiberglass materials. Generally, the decks are formed by lamination of a number of layers of material into a finished generally planar structure. Wheels are attached to the bottom of the finished decks and rotate on axles which are engaged to the trucks which engage the deck or board. Such wheels of a skateboard are frequently comprised of polyurethane or other relatively soft rubber compounds to provide a better ride to the rider and softer landing on an aerial maneuver.

Trucks from which the wheel axles project typically include a pivoting assembly with a single or split axle to rotatably support a pair of wheels. Two such wheel-engaged trucks are generally mounted on the bottom side of the board or deck, one truck assembly attached toward the front end of the board and the other truck assembly attached toward the rear end of the board. The pivoting assembly for each truck so mounted resiliently pivots about the truck's connection with the board and thereby displaces the axle from its usual orientation perpendicular to the median longitudinal axis of the skateboard to provide steering of the forward-moving board or deck. The axles are displaced by applying a downward force in the form of a rolling motion of the deck. This rolling motion of the rider on the deck tilts it and causes the trucks to twist, enabling skilled skateboarders to negotiate smooth, sharp turns in rapid succession by shifting their weight on their feet during riding.

Conventional skateboards have been formed with a plurality of plies of thin sheets of wood or veneers pressed together using adhesive such as polyvinyl glues and layers of fiberglass for reinforcement. Different woods are chosen for different performance characteristics such as bend, stiffness, spring, and toughness. The stacked layers of wood veneers and glue and fiberglass or similar woven reinforcement that make up the finished deck or board are normally pressed together in a press between forms made of aluminum, metal, ceramic, or concrete for a duration of time sufficient to cure the adhesive and form finished boards with various three shapes.

The finished board so formed will have characteristics of flexibility and spring and stiffness and resistance to torque that are directly related to the types of wood employed in the veneers used to make up the finished laminate forming the board. While production model skateboard decks may be mass produced with longevity and production requirements in mind, such mass-produced boards can lack the increased performance characteristics a custom board might have which uses specialized veneers of woods providing the desired handling characteristics.

Other considerations of board or deck manufacturers are the durability requirements of the finished product. Tricks such as the aforementioned Ollie require the rider to perform a combination of tapping the tail of the board down with the rear foot, while jumping in the air and kicking forward with the front foot. Correct timing and execution of these actions result in the board jumping into the air with the rider. The flex and spring of the board therefore must be sufficient to perform such a trick, while the strength of the board must be sufficient to absorb the shock of a 100 to 300 pound youth landing on the ground at conclusion of the trick. Additional considerations must be given to the employment of skateboards by riders to traverse common obstacles in the street, playgrounds, or skate parks and using those objects in combination with the board to perform their tricks. Sliding down bannisters, jumping from roofs, and other daring feats employing everyday structures imparts extreme force upon the landing board itself and to its laminate structure. Further, the bottom of the board frequently must endure frictional, and impact contact generally removes material from the bottom of the board. As such, there exists a need for a skateboard deck or board of laminate construction, that provides the maximum amount of spring and torque resistance characteristics to perform tricks such as the Ollie, and to navigate sharp turns that the rider may encounter. Such a board should provide sufficient internal strength to allow for the force imparted to the board from landings from many feet above the ground surface. However, such a board should still allow for a comfortable and controlled ride when the rider is not performing such extreme tricks. Still further, there exists a need for an improved deck or board for a skateboard that is highly customizable for these torque and spring characteristics using a conventional laminating forming process to allow for ease of custom and mass manufacture.

This device herein disclosed and described teaches a skateboard deck construction and method yielding highly improved spring, rebound, torque, shock absorption, and frictional characteristics in the deck produced. These improved characteristics provide great utility to a rider previously unavailable from conventional laminated wood veneer skateboard decks. The present invention achieves its intended purposes, objects and advantages over the prior art through a new and unique center component member formed of metal strips sandwiched between flexible members forming the deck and reinforced with fiberglass or carbon fiber or plastic.

In this respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other methods and systems for carrying out the several purposes of the present invention. It is important, therefore, that the claims be regarded as including such equivalent construction insofar as they do not depart from the spirit and scope of the present invention.

An object of this invention is the provision of a skateboard deck having improved handling characteristics An additional object of this invention is improving the spring and reflex characteristics of a skateboard deck.

Yet another of this invention is improving the shock absorption and vibration characteristics of a skateboard deck.

Another object of this invention is to provide such an improved skateboard deck using components that may be easily incorporated into current wood veneer manufacturing techniques.

An additional object of this invention is to provide improved torque and turning characteristics of the skateboard deck around its center axis and thereby improve steering and responsiveness of the resulting skateboard deck.

These together with other objects and advantages which will become subsequently apparent reside in the details of the construction and operation as more fully hereinafter described and claimed, reference being had to the accompanying drawings forming a part thereof, wherein like numerals refer to like parts throughout.

SUMMARY OF THE INVENTION

The device and method herein disclosed relates to a laminated skateboard deck. More particularly, the method of production and resulting deck apparatus herein described and disclosed, yield an improved skateboard deck which is highly customizable for spring, torque, turning, and shock absorbing characteristics. The disclosed novel components and techniques of the device and method and method and form of its construction are easily included in the conventional laminate manufacturing techniques of skateboard decks having multiple veneer layers. Such easy inclusion will allow for mass production or high-end customized production for the broadest market. The end result yields a skateboard having a deck which is able to handle the continual stresses imparted upon it by springing vertical jumps, hard landings from high places, grinds, rail slides, and other maneuvers and tricks. Further, shock absorption and reduction of vibration of the resulting deck is greatly enhanced, thereby providing riders with a means to help prevent fatigue and injuries during use and allowing for longer use and practice sessions.

The device features a skateboard deck formed of a plurality of layers of wood veneers chosen for durability and other characteristics and formed into a laminated structure having a surface layer for the rider's feet and a bottom layer for engagement to the wheels. Within this laminated structure is also laminated the components of the device herein described to improve the handling characteristics of the formed laminate skateboard deck.

In all preferred modes of the device there are employed vertically stacked parallel flexible elongated composite members formed of fibers in a matrix of plastic, resin, or polymer. Such fibers include one or a combination of reinforcing fibers including fiberglass, carbon fiber, aramid, nylon, or similar fibers employable in a fiber-reinforced plastic or polymer where the woven fibers are held within and reinforce a matrix of cured plastic or polymer resin. Currently employed materials cured into the polymer matrix include epoxy, vinylester or polyester, or thermosetting plastic. However, those skilled in the art will realize that other plastics, polymers or curable materials reinforced with fabric or fibers may be employed and such is anticipated. Such fiber and polymer composite members are flexible but still resist twisting along their axis. They are also elastic in nature, allowing the composite member to stretch along its axis and return to an original size much like a rubber band.

In used, the composite members generally have a center axis that follows the axis of the formed laminate deck. The flexible members employ parallel side projections from various points along their respective axis, thereby yielding a plurality of traverse cross members projecting from both sides at various points along the length of the flexible members. Sandwiched between the stacked traverse members formed along stacked flexible members are a plurality of parallel situated elongated metal, composite, or other metal-like performing members. In the current preferred mode, the elongated side members are formed of thin strips of metal such as steel having the rider's desired spring characteristics when encased in the finished laminated board between the cross members. They can also be formed of resin impregnated carbon strips or similar composite material; however, metal is currently preferred for its spring. Additionally, a third metal or carbon composite strip member may be included running along the center axis of the formed deck, or, more stacked metal members can be situated between stacked flexibly members to yield multiple layers of flexible members, each having traverse cross members, each having metal members sandwiched there between.

By laminating the various wood veneer layers together, with the device herein engaged between the veneer layers, or in a cavity formed within one or more veneer layers, the finished skateboard deck has highly improved handling characteristics for spring, to yield higher jumps and better resistance on hard landings. Vibration transmitted to the rider's feet and body are also greatly reduced. Torque characteristics around the center axis of the deck are improved by the overlapping cross members of the flexible composite members reacting in concert with the metal strips during turning maneuvers. This yields quicker turns and faster recovery from such turns to a neutral position of the deck. Spring and vertical responsiveness of the board or deck encompassing the invention herein is also vastly improved, thus yielding higher jumps and better landings for riders.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE INVENTION

Figure 1:
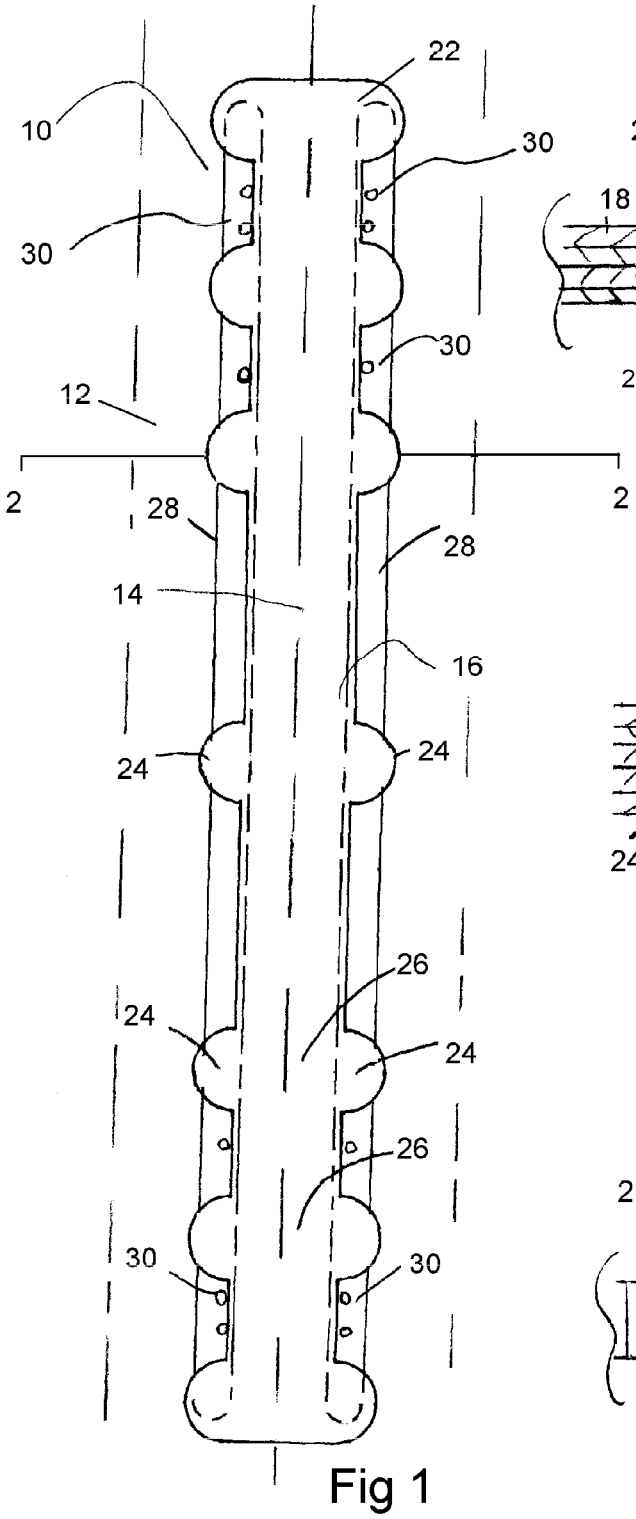
FIG. 1 is an illustrative top plan view of the central member forming the device herein showing the laminated veneer housing the composite member and metal strips in the skateboard deck in phantom line.

Referring now to the drawings in FIGS. 1-4, some preferred embodiments of the present invention in current preferred modes in accordance with the present invention are shown.

FIG. 1 depicts a top plan view of the device 10 as it would be encompassed within a skateboard deck 12 extending substantially along the center axis 14 of the deck 12. The device features a central member 16 formed of the other components herein which when operatively mounted in the deck 12 increases turning, jumping, and other performance characteristics of the formed deck 12.

The device 10 is as noted operatively mounted between layers of wood veneers 18 which are laminated together forming the deck 12 or within a cavity 20 formed within the veneer 18 layers. The multi-component central member 16 employs vertically stacked and aligned, elongated composite flexible members 22 which are formed of fiberglass, carbon fiber or similar reinforcing fabric impregnated with the appropriate resin to yield the flexible member 22 in the appropriate shape and flex characteristics. These composite flexible members 22 formed of a polymer matrix reinforced with fibers as noted, have a center axis substantially inline with the axis 14 of the deck 12 which is formed of the resulting laminated veneer 18 layers forming the upper and lower surface layers. The flexible members 22 of this composite material positioned along the axis between the layers of the deck yield a great improvement in spring, flex, and torque resistance of the rider and the members 22 alone yield a substantial improvement in performance in one preferred mode of the device 10.

In the more preferred modes of the device, the flexible members 22 work in conjunction with parallel side members 24 projecting normal to the axis 14 from various points along the composite flexible member 22. These side members 24 are preferably integral and part of the flexible members 22, and when paired on each side of the flexible members 22, form a plurality of traverse cross members 26 projecting a substantially equal distance from both sides of the center axis 14, at various points along the length of the flexible members 22. Of course, if a deck 12 with more torque resistance to one turning side or the other is desired, the cross members 26 might be formed to project unequal distances from the axis 14 and the leverage resulting from different length cross members 26 would be different in both turning directions. This might be done in cases where a track in a race has turns substantially all in one direction and the rider needs more turning capability toward one side or the other.

In a sandwiched engagement between the stacked cross members 26, extending from inline flexible members 22, are operatively placed parallel elongated members 28 formed of thin strips of metal such as spring steel or of resin impregnated composite material such as carbon fiber strips. The metal or other composite material employed can be varied to provide the individual rider's desired spring and shock absorbent characteristics for the finished deck 12 with the formed central member 16 operatively engaged within the veneer 18 layers. Different types of spring steel or composite materials may be used conforming to various AISI and SAE standards, yielding different resistance and spring characteristics depending on the length and thickness and width of the member 28 employed. Further, carbon fibers, or other synthetic fabrics operatively engaged with a resin to form a composite elongated member 28 can provide similar characteristics which may be varied. Consequently, great adjustability as to the ride characteristics of the finished deck 12 can be achieved by varying the metal or composite employed to form the elongated member 28, the composite construction, the material thickness, and the width of the composite or metal used.

Figure 3:
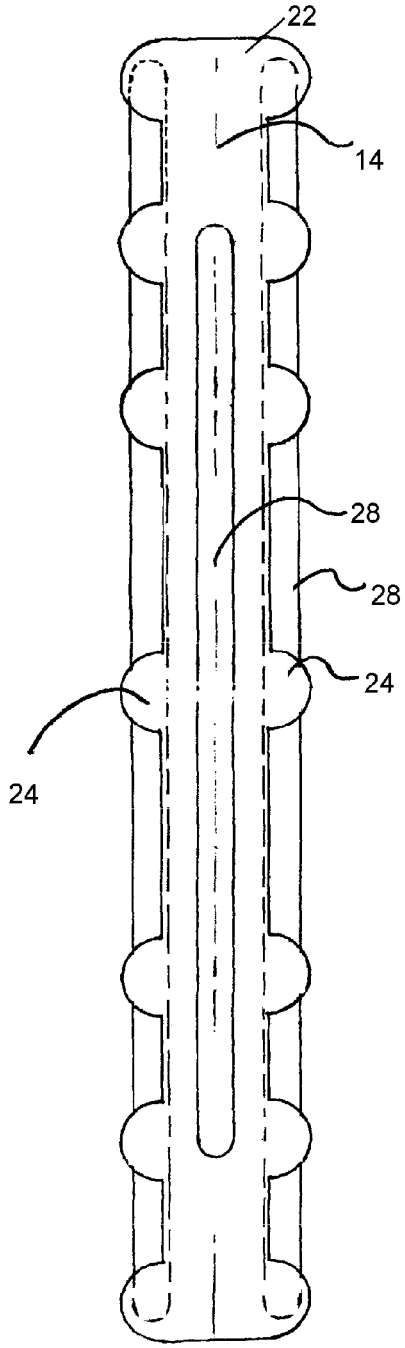
FIG. 3 is a top view of yet another skateboard deck constructed according to the present invention wherein a third metal strip is engaged between composite members along the axis.

The device as shown in FIGS. 1 and 3 shows two elongated members 28 parallel to each other and the axis 14 and sandwiched between the cross members 26 of two central members 16. The ride and torque around the axis 14 and spring along the axis 14, of the formed deck 12 can also be altered by changing the number and spacing of the formed cross members 26. As such, a means for adjustment of torque resistance around the axis 14, and spring or flex characteristics along the axis 14, is provided by changing the materials employed to form the elongated members 28, and the composite materials of the flexible members 22 employed and especially by the placement and number of cross members 26 engaging the parallel elongated members 28 sandwiched there between.

In a current preferred mode of the device 10 the exceptional improvements in performance for spring, flex, and twisting and shock absorbing characteristics with a rider on the deck 12 have been provided with the conventional trucks or axles for the wheels (not shown) engaged through both the veneer 18 layers, and also through the composite or metal elongated members 28, using mounting apertures 30 adapted to engage truck bolts or screws. As shown the apertures 30 are spaced to engage the screws or bolts that hold two types of conventional wheel axles to the deck 12 and of course the apertures 30 can be spaced differently if standard distancing of truck engagement holes change.

Figure 2:
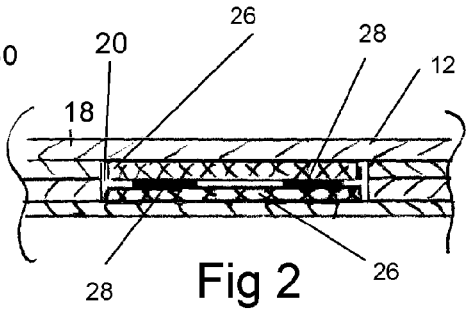
FIG. 2 is an illustrative cross-sectional view of another embodiment of the invention as if taken along line 2-2 showing the central member engaged in a relief formed in the wood veneer layers forming the skateboard deck.
Figure 2A:
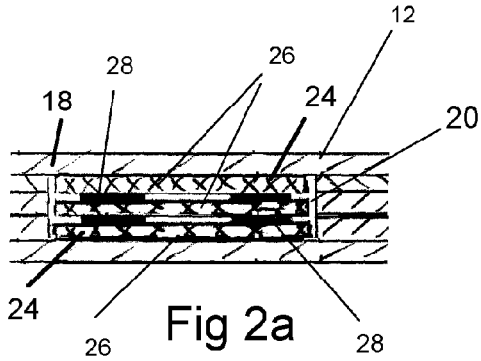
FIG. 2*a* is illustrative of a cross-sectional view of another preferred mode of the device as if taken along line 2-2 showing a stacked inline plurality of central members.

As shown in FIG. 2*a*, a plurality of central members 16 formed of the other components herein noted, can be stacked inline in-between the veneers making up the deck 12. As shown, a number of veneers are overlain and two central members are formed using an inline sandwiched engagement between the stacked side members 26, extending from three inline flexible members 22, with two layers of elongated members 28 formed of the aforementioned thin strips of metal such as spring steel or of resin impregnated composite material such as carbon fiber strips. While shown with only two layers of elongated members 28, additional layers may be formed by adding one more member 26 and sandwiching the elongated members there between.

Figure 2B:
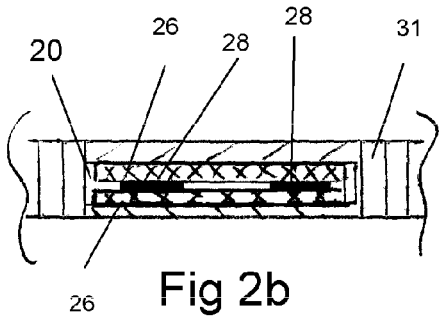
FIG. 2*b* depicts a cross sectional view of another preferred mode of the device as if taken along line 2-2 wherein side portions of the deck are composed of elongated stringers pinned with dowels.

In FIG. 2*b* there is shown the central member 16 similar to FIG. 2, and FIG. 1, with stringers 31 forming side portions of the deck 12. Conventionally the stringers 31 are of solid wood material with bamboo or other dowels (not shown) holding them engaged.

In another preferred mode of the device 10, a third metal member can be included in the component assembled central member 16 situated along the axis 14 as shown in FIG. 3. This mode of the device 12 has been found to have additional spring and jumping characteristics that are attractive to some riders wishing to spring the deck into the air. All modes of the device 10 can, as shown in FIG. 2, be engaged within the stacked and laminated veneer 18 layers in a cavity 20, or if formed thin enough, in-between the layers themselves.

Figure 4:
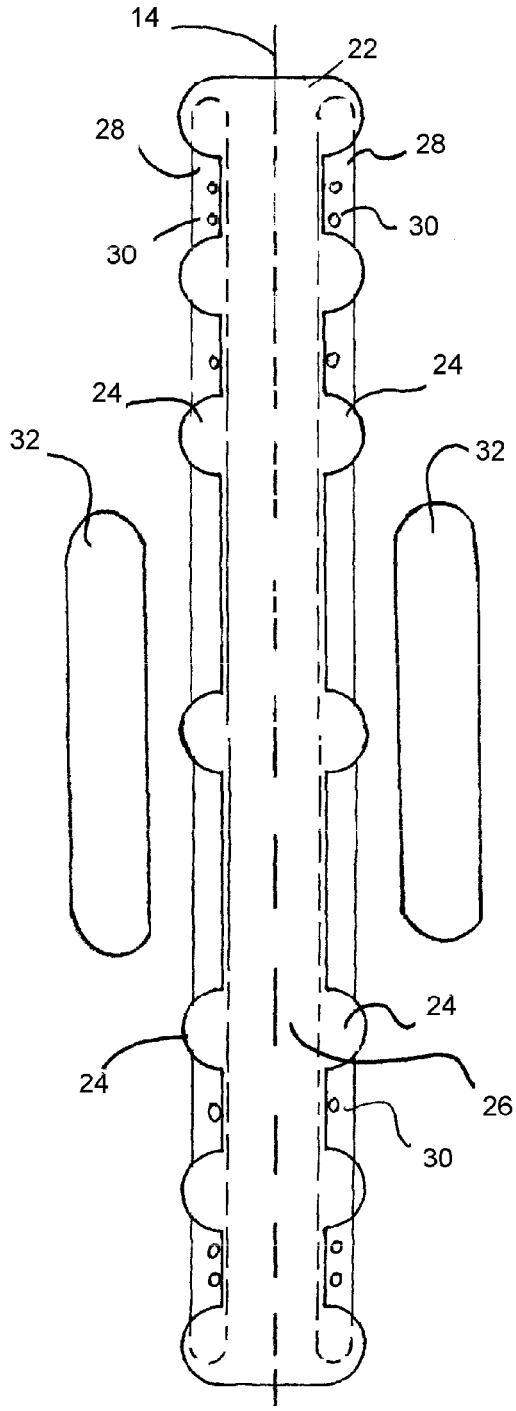
FIG. 4 is a top view of another mode of the disclosed device wherein a plurality of cork or other vibration absorbent materials in sectional layers have been included for vibration.

Additionally, all modes and embodiments of the device 10 can include means for vibration dampening. This vibration dampening may be provided by employment of member sections 32 of cork or rubber or carbon fiber or similar flexible material which form member sections 32 that are elongated and positioned between the top and bottom layers of the laminated deck on both sides of the axis 14. As depicted in FIG. 4, in addition to vibration dampening and shock absorption on landing, these member sections 32 have shown during experimentation to also significantly increase the flexibility of the deck 12 with all of the various embodiments and modes of the disclosed deck 12.

Still further, the device 10 as shown in FIG. 2 depicts a pair of composite flexible members 22 sandwiching a pair of elongated members 28 in a current preferred mode of the device 10. However, a plurality of more than just two flexible members 22, sandwiching two or more pair of members 22 can also be employed in forming the central member 16 operatively mounted in a deck 12 employing the disclosed device 10. Multiple layers of members 22 could be stacked inline, equidistant from center axis 14 or could be stacked at varying distances from the center axis 14 to yield different torque characteristics around the center axis and differing spring and flex characteristics of the formed deck 12. In between multiple flexible members 22 can be placed multiple stacked elongated members 28; for example, three inline flexible members 22 can have two elongated members 28 sandwiched on each side of the axis 14.

Consequently, skateboard decks 12 employing the device 10 disclosed herein can be easily customized for deck behavioral characteristics for the individual rider and/or the type of riding anticipated by changing one or a combination of means of adjustment of handling characteristics of twisting around the center axis of the formed deck 12, including changing the spacing of the parallel elongated members 28 from the center axis, changing the size in width and/or length of the elongated members 28 employed, changing the number of elongated members 28 employed, changing the spacing of the traverse cross members 26, changing the number of traverse cross members 26, changing the distance the traverse cross members 26 project from the center axis 14, and changing the type of metal forming the elongated members 28 sandwiched between the cross members 26. Further, means for energy storage when the deck 12 is bent by the user jumping or flexing it while riding, to spring back, is provided by changing one or a combination of the length, width, or thickness of the elongated members 28 or the material from which they are formed.

Finally, the method and apparatus for forming skateboard decks shown in the drawings and described in detail herein, disclose arrangements of elements of particular construction and configuration for illustrating preferred embodiments of structure and method of operation of the present invention. It is to be understood, however, that elements of different construction and configuration and other arrangements thereof, other than those illustrated and described, may be employed in accordance with the spirit of this invention, and any and all such changes, alternations and modifications as would occur to those skilled in the art are considered to be within the scope of this invention as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology to determine quickly from a cursory inspection the nature and essence of the technical disclosure of the application. The abstract is neither intended to define the invention of the application, which is measured by the claims, nor is it intended to be limiting as to the scope of the invention in any way.

What is claimed is:

1. A skateboard deck adapted for engagement to axles having wheels, comprising:

an elongated deck body having a center axis therethrough and having two side edges communicating between a front edge and rear edge;

said deck body formed of a plurality of layers including an upper surface layer on which a user rides and a lower surface layer adapted for engagement to said wheels;

a first composite member located between said upper surface layer and lower surface layer, said first composite member having a width extending from a central axis which is substantially aligned with said center axis;

a second composite member, having a width and length substantially the same as said first composite member, said second composite member positioned substantially inline with said first composite member, between said upper surface layer and lower surface layer;

a first plurality of cross members positioned between said upper and lower surface layers, said cross members extending from said first composite member toward both said side edges a distance away from said center axis;

a second plurality of cross members positioned between said upper and lower surface layers, said cross members extending from said second composite member toward both said side edges said distance away from said center axis; and said distance away from said center axis, exceeding said width of said first and second composite members;

a middle layer positioned between said first composite member and said second composite member; and a plurality of apertures communicating between said upper surface layer and said lower surface layer and passing through the middle layer, said apertures adapted for operative engagement of trucks providing mounts for said axles and wheels upon said lower surface of said deck body.

2. The skateboard deck of claim 1 wherein said first and second composite members are both formed of a polymer matrix reinforced with fibers.

3. The skateboard deck of claim 1 additionally comprising:
said first composite member and said first plurality of cross members being of unitary construction; and
said second composite member and said second plurality of cross members being of unitary construction.

4. The skateboard deck of claim 2 additionally comprising:
said first composite member and said first plurality of cross members being of unitary construction and formed of said polymer matrix reinforced with fibers; and
said second composite member and said second plurality of cross members being of unitary construction and formed of said polymer matrix reinforced with fibers.

5. The skateboard deck of claim 1 additionally comprising:
said middle layer comprising;
a first elongated metal side member running parallel to said center axis positioned between said first and second plurality of cross members at a position between said center axis and a first of said side edges;
a second elongated metal side member, running parallel to said center axis, positioned between said first and second plurality of cross members at a position between said center axis and a second of said side edges and
said first and second elongated side members each having a width, thickness, and length.

6. The skateboard deck of claim 2 additionally comprising:
said middle layer comprising;
a first elongated metal side member running parallel to said center axis positioned between said first and second plurality of cross members at a position between said center axis and a first of said side edges;
a second elongated metal side member, running parallel to said center axis, positioned between said first and second plurality of cross members at a position between said center axis and a second of said side edges; and
said first and second elongated side members each having a width, thickness, and length.

7. The skateboard deck of claim 3 additionally comprising:
said middle layer comprising;
a first elongated metal side member running parallel to said center axis positioned between said first and second plurality of cross members at a position between said center axis and a first of said side edges;
a second elongated metal side member, running parallel to said center axis, positioned between said first and second plurality of cross members at a position between said center axis and a second of said side edges and
said first and second elongated side members each having a width, thickness, and length.

8. The skateboard deck of claim 4 additionally comprising:
said middle layer comprising;
a first elongated metal side member running parallel to said center axis positioned between said first and second plurality of cross members at a position between said center axis and a first of said side edges;
a second elongated metal side member, running parallel to said center axis, positioned between said first and second plurality of cross members at a position between said center axis and a second of said side edges and
said first and second elongated side members each having a width, thickness, and length.

9. The skateboard deck of claim 1 additionally comprising:
said middle layer comprising;
an elongated planar metal central member running along said center axis sandwiched between said first and second composite members.

10. The skateboard deck of claim 2 additionally comprising:
said middle layer comprising;
an elongated planar metal central member running along said center axis sandwiched between said first and second composite members.

11. The skateboard deck of claim 6 additionally comprising:
said middle layer comprising;
an elongated planar metal central member running along said center axis sandwiched between said first and second composite members.

12. The skateboard deck of claim 1 additionally comprising:
means to adjust resistance to twisting of said deck around said axis provided by changing one or both of:
changing the number of first plurality of cross members and second plurality of cross members, and
increasing or decreasing said distance away from said center axis said first plurality and second plurality of cross members extend.

13. The skateboard deck of claim 2 additionally comprising:
means to adjust resistance to twisting of said deck around said axis provided by changing one or both of:
changing the number of first plurality of cross members and second plurality of cross members, and
increasing or decreasing said distance away from said center axis said first plurality and second plurality of cross members extend.

14. The skateboard deck of claim 6 additionally comprising:
means to adjust resistance to twisting of said deck around said axis provided by changing one or both of:
changing the number of first plurality of cross members and second plurality of cross members, and
increasing or decreasing said distance away from said center axis said first plurality and second plurality of cross members extend.

15. The skateboard deck of claim 6 additionally comprising:
vibration absorbent material forming absorbent members;
a first of said absorbent members positioned between said upper and lower surface and said center axis and a first of said two side edges; and
a second of said absorbent members positioned between said upper and lower surface and said center axis and a second of said two side edges.

16. The skateboard deck of claim 11 additionally comprising:
vibration absorbent material forming absorbent members;
a first of said absorbent members positioned between said upper and lower surface and said center axis and a first of said two side edges; and
a second of said absorbent members positioned between said upper and lower surface and said center axis and a second of said two side edges.

17. The skateboard deck of claim 6 additionally comprising:
means to adjust the energy storage of said deck when bent by a rider provided by changing one or a combination of said width, thickness, and length of said respective first and second side members.

18. The skateboard deck of claim 7 additionally comprising:

apertures communicating through said deck and through said first and second side members; and said apertures sized to accommodate fasteners employed to engage axles to said deck, said fasteners when traversing said apertures through said first and second side members providing means to engage said axle to said first and second side members.

19. The skateboard deck of claim 7 additionally comprising:

a third composite member, having a width and length and third plurality of cross members, all substantially the same as said first and second composite members, and positioned substantially inline with said first and second composite members, between said upper surface layer and lower surface layer;

a third elongated metal side member running parallel to said center axis positioned between said second and third plurality of cross members at a position between said center axis and a first of said side edges;

and said first and third, and said second and fourth cross members, being respectively aligned.

* * * * *